United States Patent [19]

Smith

[11] Patent Number: 5,069,414

[45] Date of Patent: Dec. 3, 1991

[54] BOAT ENGINE MOUNTING

[75] Inventor: Scott A. Smith, Holland, Mich.

[73] Assignee: S2 Yachts Incorporated, Holland, Mich.

[21] Appl. No.: 517,234

[22] Filed: May 1, 1990

[51] Int. Cl.[5] ..... F16M 1/00

[52] U.S. Cl. ..... 248/638; 440/111

[58] Field of Search ..... 248/637, 671, 635, 188, 248/638; 440/111, 61; 403/7, 8, 47, 231, 255, 254

[56] References Cited

U.S. PATENT DOCUMENTS

| | | | |
|---|---|---|---|
| 354,331 | 12/1886 | Matthews | 403/8 |
| 655,358 | 8/1900 | Smyth | 248/188 |
| 3,845,923 | 11/1974 | Atkinson | 440/111 X |
| 3,929,089 | 12/1975 | Lambrecht | 440/111 X |
| 4,003,330 | 1/1977 | Compton | 440/111 |
| 4,068,958 | 1/1978 | Beckershoff | 403/47 |
| 4,124,317 | 11/1978 | Dauth | 403/254 |
| 4,666,412 | 5/1987 | Rawlings | 248/635 |
| 4,778,420 | 10/1988 | Greenberg | 248/637 X |
| 4,778,421 | 10/1988 | Greenberg | 248/671 X |

FOREIGN PATENT DOCUMENTS

| | | | |
|---|---|---|---|
| 341567 | 1/1931 | United Kingdom | 440/111 |

*Primary Examiner*—J. Franklin Foss

*Attorney, Agent, or Firm*—Varnum, Riddering, Schmidt & Howlett

[57] ABSTRACT

A boat engine mounting in which an engine mount is secured to a stringer extending longitudinally of the hull, the mount being secured by a bolt received in a vertical bore in the stringer and threaded in an elongate cylindrical nut received in turn in a complementary horizontal bore intersecting the vertical bore.

8 Claims, 3 Drawing Sheets

BOAT ENGINE MOUNTING

BACKGROUND OF THE INVENTION

This invention relates in general to new and useful improvements in boat engine mountings, and more specifically to the mounting of an inboard engine or a so-called inboard-outboard engine on stringers of a boat hull.

In the conventional manufacture of boats to be powered by one or more inboard engines or so-called inboard-outboard engines, the engine or engines are mounted on and supported by stringers, the name commonly applied to the elongate inboard frame members which extend in fore-and-aft directions along the very bottom of the hull. The stringers are often formed of a laminated wood core encased in a heavy fiberglass-reinforced coating, the laminae or plies of the core extending longitudinally in substantially vertical planes. However, the stringers may be formed of any suitable material such as rigid foamed plastics, solid hardwood, and aluminum or other metals, and though in modern boat construction the stringer material is usually covered by a fiberglass-reinforced coating, this is not always the case. In any event, it will be apparent from the following specification that the present invention is not limited to any particular stringer construction.

However, the features, objects and advantages of the invention may be suitably explained and understood with reference, by way of example, to stringers having laminated wooden cores encased in fiberglass, as first mentioned hereinabove. In the case of such a stringer, if the engine mounts were to be secured by threaded fasteners such as conventional lag bolts, driven vertically into an unmodified stringer from its upper surface, the fasteners would not hold for long in its laminated structure.

As is shown in the accompanying drawings and explained with greater particularity hereinbelow, one expedient presently employed to deal with this problem is to form a notch or recess at the upper part of the stringer, and before the fiberglass coating is applied, to fit a complementary insert of solid hardwood into the notch. The fiberglass coating covers the insert as well as the remainder of the stringer, and the engine mount may readily be secured by a lag bolt or lag bolts driven through the fiberglass and into the solid insert.

Also shown in the accompanying drawings and explained with greater particularity hereinbelow is another expedient commonly employed in which a notch is cut in the upper profile of the stringer. In this instance, however, the fiberglass coating is applied to the stringer so notched, and a custom-made cap is then received over the stringer to extend across the notch, the cap being secured to the stringer by transverse bolts. The boat engine mount is then directly bolted to the cap and secured by a fastening nut or nuts accommodated in the space below the cap provided by the notch.

Both of these prior constructions are subject to significant disadvantages which are set forth hereinbelow.

SUMMARY OF THE INVENTION

In accordance with this invention, a boat engine mounting is provided by first preparing a pair of intersecting bores in a stringer, one bore extending vertically downward from the upper surface of the stringer, the other extending transversely of the stringer from at least one side thereof, then inserting a nut into the transverse bore and aligning the threaded bore of the nut with the vertical bore in the stringer. A bolt passed through an engine mount may then be received in the vertical bore and threaded into the bore of the nut to secure the mount to the stringer.

The intersecting bores will normally be cylindrical and the nut is preferably in the form of a rod having an outside diameter equivalent to the inside diameter of the transverse bore so that the nut may be received snugly therein. Preferably the rodlike nut is of such dimensions that at least one of its opposite ends will project outwardly of the stringer when it is inserted in the transverse bore and its threaded bore is aligned with the vertical bore, so that the projecting end may be grasped throughout insertion, alignment and removal of the nut. Optionally, the transverse bore may pierce the stringer entirely through, and the nut may be made of a length whereby both of its opposite ends project outwardly of the stringer at either side thereof for even greater ease of manipulation.

These and other features, objects and advantages of the invention will be apparent from the ensuing description in conjunction with the accompanying drawings and the appended claims.

THE DRAWINGS

Figure 5:
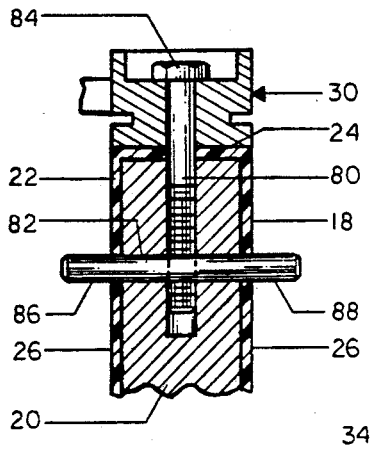
Figure 4:
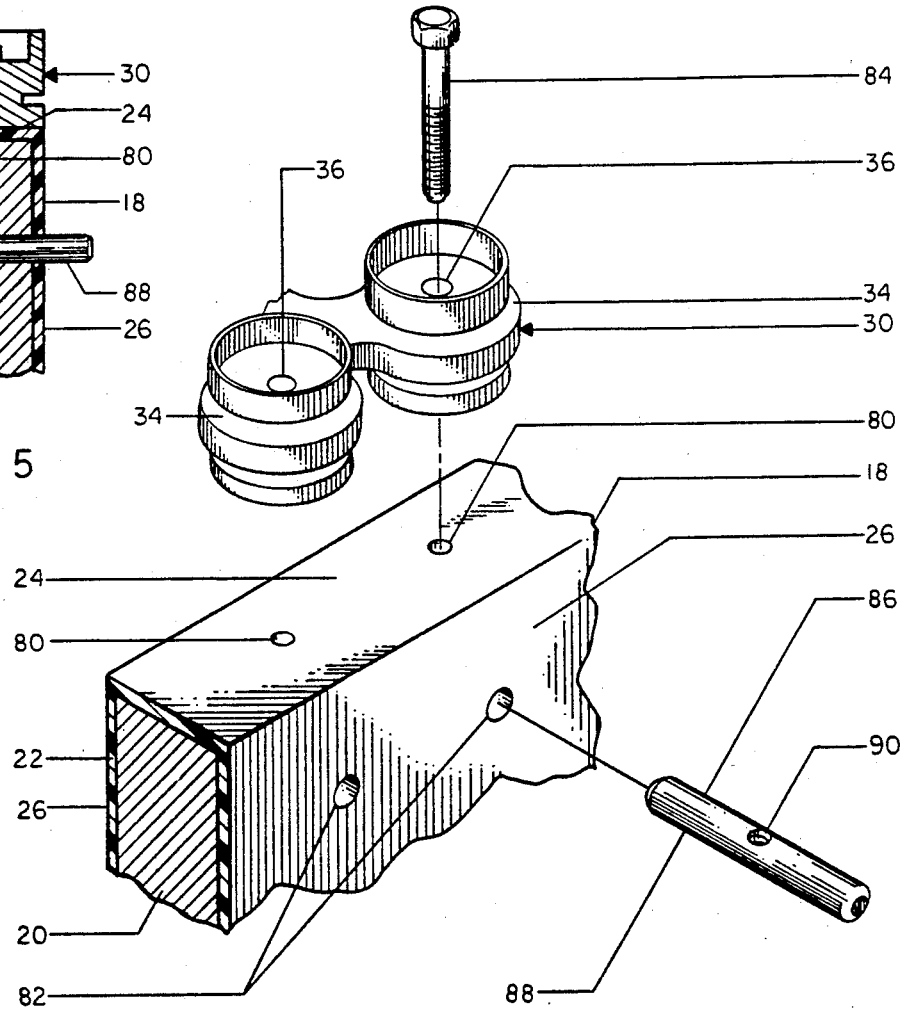

FIG. 4 is an exploded perspective view, partially in section and fragmentary in part, of a boat engine mounting in accordance with the invention; and FIG. 5 is a transverse sectional view taken through a stringer shown in FIG. 4 and illustrating the manner in which a mounting bolt is secured in place by way of a mounting nut received in the stringer, and including a form of engine mount modified from that shown in FIG. 4.

PRIOR ART CONSTRUCTIONS

Figure 1:
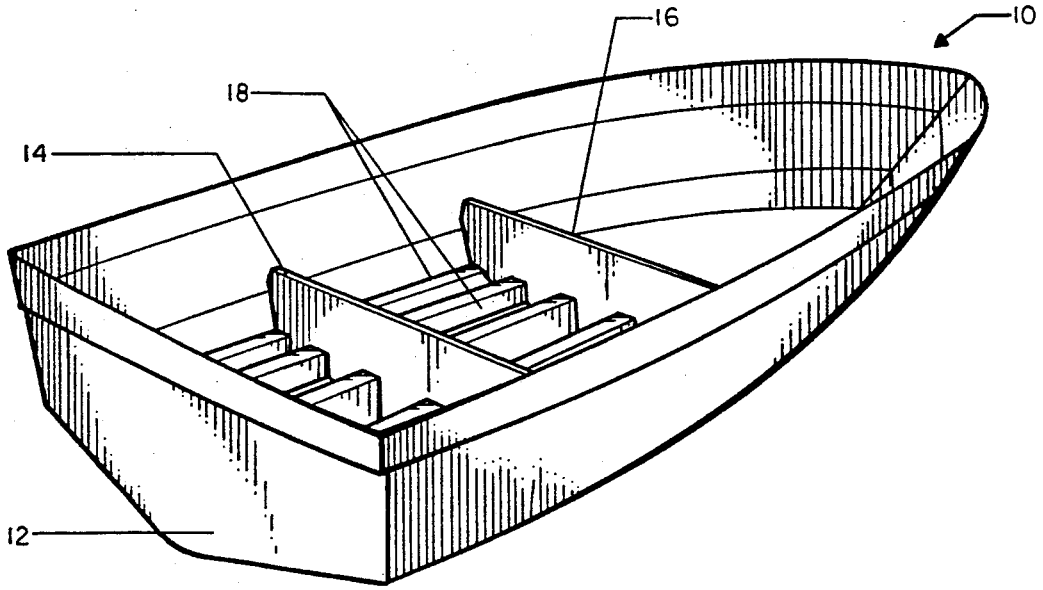
FIG. 1 (PRIOR ART)
FIG. 1 is a schematic perspective view, from above, abaft and starboard, of a boat hull of the prior art, incorporating therein longitudinally extending stringers upon which engine mounts may be received.

Referring first to FIG. 1, a typical prior art boat hull, generally identified by the numeral 10, includes a transom 12 closing the stern, and bulkheads 14, 16. The hull also includes a plurality of stringers 18 which extend longitudinally toward the bow from the transom, in this instance only to the forward bulkhead 16, piercing the intermediate bulkhead 14. Certain ones of the stringers may be employed to mount and support the weight of one or more engines, not shown, for powering a boat comprising hull 10.

Figure 2:
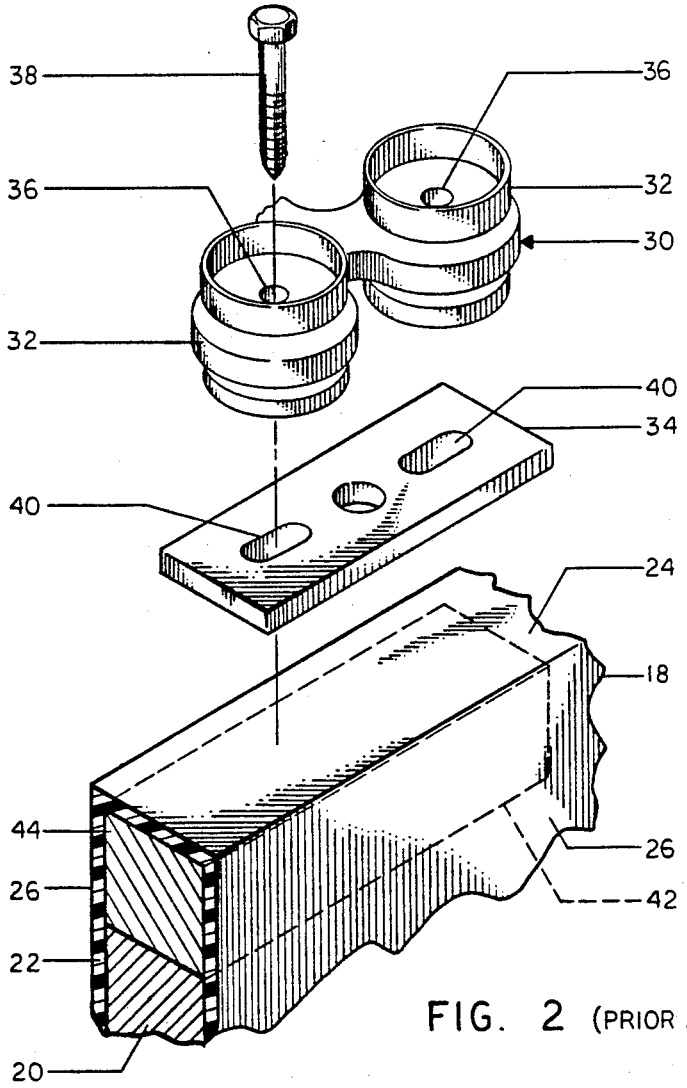
FIG. 2 (PRIOR ART)
FIG. 2 is an exploded perspective view, partially in section and fragmentary in part, showing a boat engine mounting of the prior art which employs a hardwood insert for a stringer of a boat hull.

In FIG. 2 there is shown fragmentarily a stringer 18 of the type which comprises a multi-ply or laminated structure, represented generally at 20, formed of longitudinally extending, vertically disposed wooden laminae or plies, not individually depicted, which are suitably laminated together in well-known manner. Also, in well-known manner, laminated structure 20 is covered by a reinforced plastic preferably in the form of a heavy fiberglass coating 22. The portion of stringer 18 represented in FIG. 2 presents an upper surface 24 thereof and opposite lateral surfaces 26.

One of the prior engine mountings mentioned hereinabove is shown in FIG. 2. Such a mounting is typically one of a plurality of similar mountings for each boat engine associated normally with at least two stringers, one at either side of the engine. More particularly, a conventional engine mount 30, shown in FIG. 2 to be of a type formed integrally with other components of its respective engine (not shown) but which may vary in constructional particulars from engine to engine, includes a pair of integrally formed mounting portions 32. When secured, engine mount 30 overlies stringer 18 and is seated on its upper surface 24 but is normally spaced therefrom by means such as an intervening shim 34.

Each of the engine mount portions 32 is provided with a vertical bore or passage 36 through which a mounting bolt 38, one of which is shown in FIG. 2, may be passed. The shim 34 is provided with slotted openings 40 to accommodate the mounting bolts. In the conventional type of engine mounting represented in FIG. 2, each mounting bolt 38 preferably takes the form of a lag bolt, as shown, suitably formed of stainless steel. However, if it were to be driven directly into laminated structure 20, a lag bolt would tend to spread the plies thereof and would otherwise fail to achieve the purchase necessary to hold in the stringer and prevent failure of the mounting in the presence of engine vibration and forces tending to lift the engine from the stringers.

To avoid this wholly unsatisfactory condition, before stringer 18 is covered by fiberglass coating 22 a notch 42 of any suitable configuration is cut in the upper part of laminated structure 20 to receive a complementary insert 44 of solid hardwood, mahogany for example, over which the fiberglass coating is then applied. Insert 44 may be secured in place, as by means of adhesive (not shown), and it will be confined to its position in the notch by the fiberglass. Although insert 44 has been illustrated as being of the same width as stringer 18, the notch is often cut as a narrower recess, whereby it is surrounded on all lateral sides by laminated structure 20, and only the upper surface of insert 44 is presented to the fiberglass coating.

With the prior stringer construction shown in FIG. 2, engine mount 30 may be secured to stringer 18 by driving the lag bolts into insert 44, preferably after boring pilot holes in the insert at the appropriate locations, where under normal conditions the lag bolts can be expected to hold, at least initially, in the comparatively homogeneous material of the solid hardwood from which the insert is formed.

The provision of notch 42 in its proper location along the length of stringer 18, and the cutting and fitting of insert 44 in the notch, necessarily increase the costs of labor and material. The mounting of FIG. 2 is deficient in other respects, however, of even greater importance. First, when the engine has been mounted and demounted several times, the threads of the bore (not shown) formed by each lag bolt 38 in insert 44 tend to become rounded or flattened and eventually stripped entirely, with corresponding loss of holding strength. Further, once the integrity of fiberglass coating 22 has been breached by the lag bolts, the wood of the insert surrounding the bore is exposed to moisture and is subject to consequent softening and rot, with severe or total loss of holding strength.

Figure 3:
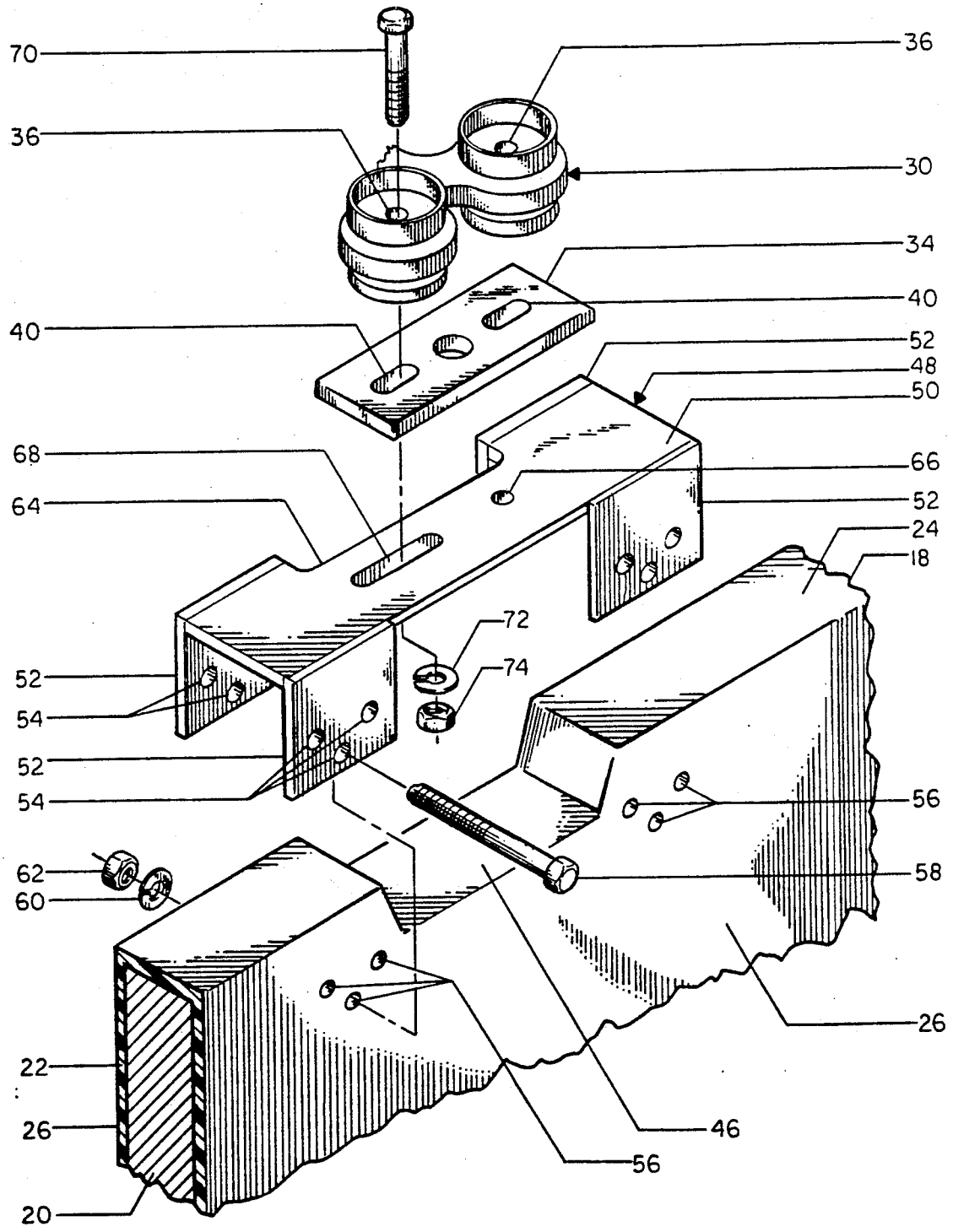
FIG. 3 (PRIOR ART)
FIG. 3 is an exploded perspective view, partially in section and fragmentary in part, showing another boat engine mounting of the prior art which employs a custom-made cap for a notched stringer of a boat hull.

FIG. 3 illustrates another boat engine mounting of the prior art, also mentioned hereinabove. Here again a notch is formed in the upper part of laminated structure 20 of stringer 18, but in this case no insert is fitted in the notch, which is identified in FIG. 3 by the numeral 46. After notch 46 is formed, fiberglass coating 22 is applied and follows the contour of the notch, as shown, whereby notch 46 interrupts upper surface 24 of the stringer.

Instead of an insert, the mounting of FIG. 3 employs a special cap, generally identified by the numeral 48. Because the structure of the cap must vary in accordance with the type and model of the engine to be mounted and also in accordance with the dimensions of the stringers from hull to hull, it is not mass produced but is custom welded from parts cut from stainless steel plate stock. In the illustrated cap 48, these parts include a top plate 50 and a pair of flange plates 52 at each of the opposite ends of the plate 50.

The width of top plate 50 at either end thereof is selected to match the width of stringer 18 so that each pair of flange plates 52 will snugly straddle stringer 18 in engagement with its opposite lateral surfaces 26. The length of top plate 50 is selected so that it will bridge notch 46 to engage upper surface 24 of the stringer at either end of the notch.

Each flange plate 52 is pierced through by a group of bores 54. When the appropriate location of cap 48 on stringer 18 has been determined, bores 56 are formed to extend through stringer 18 in groupings which will be aligned with the groups of bores 54 in cap 48. When the cap has been seated on the stringer, hex-head machine bolts 58 are passed through the aligned bores 54, 56 and each is secured in place by the application of a lock washer 60 and a nut 62. It is to be noted particularly that this manner of fastening cap 48 to the stringer is most secure because bolts 58 pass transversely through the laminae or plies (not individually shown) of which laminated structure 20 is formed.

Engine mount 30 may then be seated on cap 48 above notch 46. For convenient access to the underside of top plate 50 in securing engine mount 30 to cap 48, plate 50 is often indented, as at 64. It is also provided with suitable openings 66, 68, one of which, 68, is normally elongated to compensate for any misalignment with the bores 36 of engine mount 30.

Hex-head machine bolts 70 are passed downwardly through openings 36 in the engine mount, through opening 40 of shim 34 if the shim is employed, and through one of the openings 66, or 68 as shown. A lock washer 72 and a nut 74 are then applied to the lower end of bolt 70 at the underside of top plate 50 to clamp engine mount 30 in place, notch 46 providing clearance for nut 74 with washer 72 and for tools employed during mounting an demounting.

Because of small-volume demand, caps 48 are not normally mass produced, as by forging or stamping, but are cut, welded and bored individually or in small lots according to engine and hull type, and because notch 46 and bores 56 must be located and formed in stringer 18, the prior-art engine mounting of FIG. 3, though it may ordinarily be more secure and durable than the mounting of FIG. 2, is much less economical.

THE ILLUSTRATED EMBODIMENT OF THE INVENTION

With the deficiencies of the foregoing examples of the prior art in mind, reference is now made to FIGS. 4 and 5, in which is illustrated a boat engine mounting according to the present invention. As is represented in FIG. 4, engine mount 30 may be identical with the engine mounts shown respectively in FIGS. 2 and 3, or it may take another form such as the modification shown in FIG. 4. In any case it is to be noted that, in accordance with the invention, no notch need be formed in stringer 18, which is otherwise of construction similar to that of the stringers respectively illustrated in FIGS. 2 and 3.

A suitable jig (not shown) may be readily devised by persons of ordinary skill in the art and employed to locate the mounting of the present invention correctly in relation to stringer 18. Employing such a jig to determine the correct position or positions on the stringer of the fastening means to be carried by an engine mount, two pairs of intersecting bores 80, 82 are formed, each pair comprising a vertical bore 80 extending downwardly into the stringer 18 from its upper surface 24 to a predetermined minimum depth, and a horizontal bore 82 extending transversely through stringer 18 at a predetermined distance from the upper surface thereof to intersect the respective vertical bore 80. Bores 80 and 82 are preferably cylindrical, and the diameter of each horizontal bore 82 will normally be greater than the diameter of the corresponding vertical bore 80.

The mounting hardware is next brought forward, comprising engine mount 30 which is then bolted to stringer 18 by means of an ordinary hex-head machine bolt 84 to be carried thereby and a nut 86 of special configuration, both preferably formed of stainless steel, the nut being seated in horizontal bore 82 and bolt 84 being inserted downwardly in vertical bore 80 as engine mount 30 is brought to overly stringer 18 in supported relation therewith. More particularly, nut 86 is in the form of a length of rod 88 having a transverse internal bore 90 which pierces it through and is threaded to mate with the thread of bolt 84. The length of rod 88 is selected so that its opposite ends will project outwardly of opposite lateral surfaces 26 of stringer 18, as shown in FIG. 5, when its threaded bore is aligned with vertical bore 82, whereby at least one end of the nut will be exposed at all times to facilitate grasping and manipulating it during insertion and removal from the respective horizontal bore 82 and during alignment of its threaded bore 90 thereof with the respective vertical bore 80 and the lower end of bolt 84.

Bolt 84 is inserted through one of the bores 36 in engine mount 30 into the respective vertical bore 80 in stringer 18 and is then threaded into transverse bore 90 of nut 86. The internal diameter of each horizontal bore 82 is complementary to the outside diameter of nut 86 to provide a snug fit, and the length of nut 86 is such that a bearing area or lever arm is provided on either side of transverse bore 90 of a length adequate to cooperate with the wall of the respective horizontal bore 82 in maintaining the position of the nut and thus the security of the mounting. Most importantly, horizontal bores 82 extend transversely of the laminae or plies (not individually shown) which make up laminated structure 20 of stringer 18, whereby the laminated structure imparts great holding strength to each nut 86 and does so even after numerous mountings and demountings of the engine.

Referring particularly to FIG. 5, though horizontal bore 82 is shown to pierce stringer 18 completely through, and nut 86 is shown to project from stringer 18 at both of its opposite lateral surfaces 26, it will be apparent that in accordance with the principles of the invention horizontal bore 82 might be a blind bore penetrating stringer 18 to an extent short of the full transverse width thereof and extending inwardly of the stringer from only one of its lateral surfaces 26, whereby the nut would project only from that side of the stringer. In any case, horizontal bore 82 extends in both directions beyond its intersection with the respective vertical bore 80 in order adequately to accommodate the rod-shaped nut having threaded bore 90, but vertical bore 80 need not extend below its intersection with horizontal bore 82 if bolt 84 is replaced by a bolt of an appropriate lesser length.

One or more shims, such as the shim 34 of FIG. 2 or FIG. 3, will normally be placed between stringer 18 and engine mount 30, but have been omitted from FIGS. 4 and 5.

For completeness of disclosure, it is pointed out that the engine mount may vary not only in configuration, but also in the number of engine mounts provided per engine. For example, inboard engines normally incorporate four engine mounts each, and inboard-outboard engines two mounts each. Normally, all such mounts call for two fasteners each, in the manner of the illustrated engine mount 30. Moreover, while the engine mounts shown in the accompanying drawings are of.. types which are formed integrally with other engine components, other engine mounts may comprise assemblies of two or more discrete elements. In any case, the specific form and number of the engine mounts form no part of this invention.

It will be recognized from the foregoing particular description in conjunction with the accompanying drawings that a boat engine mounting in accordance with the present invention represents, relative to the prior art described herein, improved strength and durability, while its simplicity provides improved economy and ease of manufacture.

While the invention has been described in connection with a specific embodiment thereof, it will be understood that this is by way of illustration and not of limitation, and that the scope of the appended claims should be construed as broadly as the prior art will permit.

What is claimed is:

1. A boat engine mounting in a boat hull having a plurality of stringers, including an engine mount overlying one of the stringers for support thereby, at least one pair of intersecting bores formed in said one stringer and comprising a horizontal bore extending transversely of said stringer from a lateral surface thereof, and a vertical bore extending downwardly into said stringer from an upper surface thereof to intersect the horizontal bore, a nut seated in the horizontal bore and having a threaded bore aligned with the vertical bore, and a fastener carried by the engine mount and having a threaded shaft extending downwardly in the vertical bore and matingly received in the threaded bore to secure the engine mount to said stringer.

2. A boat engine mounting according to claim 1, wherein the nut comprises a rod transversely pierced through by the threaded bore.

3. A boat engine mounting according to claim 2, wherein the rod has an end spaced from the threaded bore a distance to project beyond said lateral surface of said stringer when the threaded bore is aligned with the vertical bore, thereby to facilitate manipulation of the rod.

4. A boat engine mounting according to claim 2, wherein the horizontal bore extends transversely through said stringer, and the rod is of a length greater than the transverse width of said stringer, whereby at least one of the opposite ends of the rod projects outwardly of said stringer at all times, thereby to facilitate manipulation of the rod.

5. A boat engine mounting according to claim 1, including shim means positioned between the engine mount and said stringer.

6. A boat engine mounting according to claim 2, wherein the fastener comprises a bolt.

7. A method of preparing a stringer of a boat hull for receiving an engine mount provided with a downwardly extending threaded fastener, comprising the steps of determining the position of such threaded fastener relative to an upper surface of the stringer, at said position forming a vertical bore extending downwardly into the stringer from an upper surface thereof, and forming a horizontal bore extending transversely of the stringer from a lateral surface thereof in intersecting relation with the vertical bore.

8. A method of securing an engine mount having a downwardly extending threaded fastener to a stringer of a boat hull, comprising the steps of determining the position of such threaded fastener relative to an upper surface of the stringer, at said position forming a vertical bore extending downwardly into the stringer from an upper surface thereof, forming a horizontal bore extending transversely of the stringer from a lateral surface thereof in intersecting relation with the vertical bore, providing an elongate nut having a transverse threaded bore, inserting the nut into the horizontal bore, aligning the transverse threaded bore with the vertical bore, bringing the engine mount to overly the stringer in supported relation therewith while inserting the threaded fastener downwardly in the vertical bore, and engaging the threaded fastener in the threaded bore of the nut.

* * * * *